United States Patent [19]

Treichl

[11] Patent Number: 5,077,647

[45] Date of Patent: Dec. 31, 1991

[54] LAMP HOLDER

[76] Inventor: Manfred Treichl, Blasius-Hueber-Strasse 10, A-6020 Innsbrunk, Austria

[21] Appl. No.: 573,010

[22] PCT Filed: May 2, 1989

[86] PCT No.: PCT/AT89/00042

§ 371 Date: Oct. 29, 1990

§ 102(e) Date: Oct. 29, 1990

[87] PCT Pub. No.: WO89/11062

PCT Pub. Date: Nov. 16, 1989

[30] Foreign Application Priority Data

May 3, 1988 [AT] Austria ..... 1139/88

[51] Int. Cl.[5] ..... F21V 21/30

[52] U.S. Cl. ..... 362/287; 362/391; 362/427

[58] Field of Search ..... 362/391, 285, 287, 418, 362/419, 427; 439/6, 10, 13

[56] References Cited

U.S. PATENT DOCUMENTS

| | | | |
|---|---|---|---|
| 1,813,863 | 7/1931 | Nightingale | 362/391 |
| 4,837,667 | 6/1989 | Grau | 362/419 |

FOREIGN PATENT DOCUMENTS

| | | | |
|---|---|---|---|
| 284716 | 1/1988 | European Pat. Off. . | |
| 550640 | 3/1923 | France . | |
| 65428 | 9/1913 | Switzerland | 362/391 |
| 8802460 | 4/1988 | World Int. Prop. O. . | |

*Primary Examiner*—Ira S. Lazarus
*Assistant Examiner*—Richard R. Cole
*Attorney, Agent, or Firm*—Hale and Dorr

[57] ABSTRACT

A lampholder for a low-voltage lamp comprises an insulating base (1) and two connecting terminals (2), and can be rotated about an axis of rotation (10) formed by two mutually aligned holes (3) for the passage of leads in the connecting terminals (2). Preferably, a second base (21) is arranged on the two connecting terminals (2) on the opposite side of the axis of rotation (10) to the first base (1).

7 Claims, 4 Drawing Sheets

LAMP HOLDER

Figure 1:
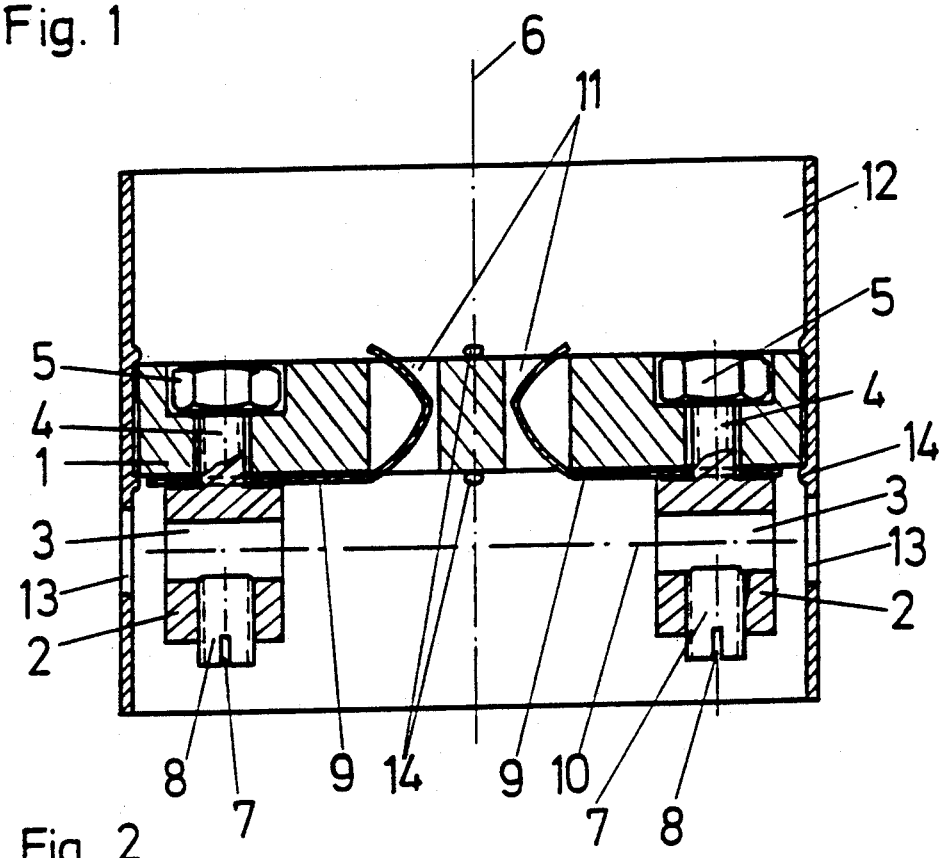

The invention concerns a lamp holder for a low voltage lamp rotatable about an axis, having an insulating cap which has two connection terminals connected conductively to the lamp contacts and each having a receiving bore for a flexurally stiff conductor.

A lighting fixture with a lamp holder which is swivellable in the manner of a universal joint is known, for example, from German Utility Model 8,633,208. Arranged on the lamp holder at the end are conventional screw terminals into which the two conductor ends are inserted parallel to one another. The two flexurally stiff ends are multiply bent in such a way that the ends lie on the axis of rotation and can be supported in bearing bushes of a continuing conductor section.

WO-A-88/02460 also shows a lamp holder which is swivellable in the manner of a universal joint, with two electrically conductive rods projecting diametrically from the cap and being fixed in the cap. In the end region of each electrically conductive rod, the interior of which is accessible, there is provided a radial blind hole for receiving one of the two contact pins of the lamp to be inserted, so that the lamp can be placed directly on the electrically conductive rods. The outer ends of the electrically conductive rods are rotatably mounted in support pieces in the form of quarter-circle arcs, so that the first axis of rotation of the universal joint is defined by the rotary bearing of the curved support pieces.

It is now the object of the invention to facilitate the formation of an axis of rotation at the lamp holder.

This object is achieved according to the invention in that the two connection terminals of the cap form bearing bushes of the lamp holder and have conductor receiving bores aligned with one another.

Consequently, the conductor ends engaging in the bearing bushes form a bearing axis about which the holder is rotatable, so that by contrast with the prior art quoted above there is no need for the conductor adaptors together with the additional bearing bushes. Since low-voltage lighting fixtures of this type also serve decorative purposes, the result is a further advantage that it is possible to provide at the two connection terminals a second cap which is with respect to the axis of rotation.

Further, there arises a certain reversal of the carrier function, i.e. the connection terminals represent the carrier component for one or two caps, whereas normally the cap also forms the carrier component for the connection terminals. In a further preferred embodiment, it is envisaged that each cap is formed by a cylindrical disc having mounting bores diametrical to the disc axis, and that there are provided at each connection terminal perpendicular to the conductor receiving bore threaded pins which in each case project through a mounting bore of a cap. In this way, a structurally very simple, light embodiment is achieved, a shell, which can be latched to a cap disc, preferably providing an enveloping cover for one or both holders.

Commercial low-voltage lamps mostly have contact pins, so that the lamp holders have plug-in contacts, and therefore the caps have plug-in openings for the contact pins. A preferred embodiment of a lamp holder according to the invention having plug-in contacts now provides that each threaded pin penetrates a flat contact spring having a curved contact stud projecting into the plug-in opening of the contact pins. The clamping spring thus establishes both the electrical and also the frictiontight connection between the lamp and the lamp holder, it having emerged that so-called cold-mirror lamps, that is to say such as have a glazed reflector shade, and therefore a relatively high weight, are also perfectly clamped.

With regard to the state of the art quoted at the beginning, screw terminals are provided as connection terminals, which is also possible without any difficulty with regard to the lamp holder according to the invention. In this case, at least one of the two threaded pins can be formed by the clamping screw of the screw terminal. If a headless clamping screw is employed, the cap can be fixed by means of a nut which can be screwed onto the clamping screw. By contrast, another embodiment can provide that the connection terminals form screwless terminals, the contact spring having a contact stud inclined in the plug-in direction and associated with the conductor receiving bores.

The invention will now be described in more detail below with reference to the figures in the attached drawings, and to several illustrative embodiments, without being restricted thereto.

Figure 6:
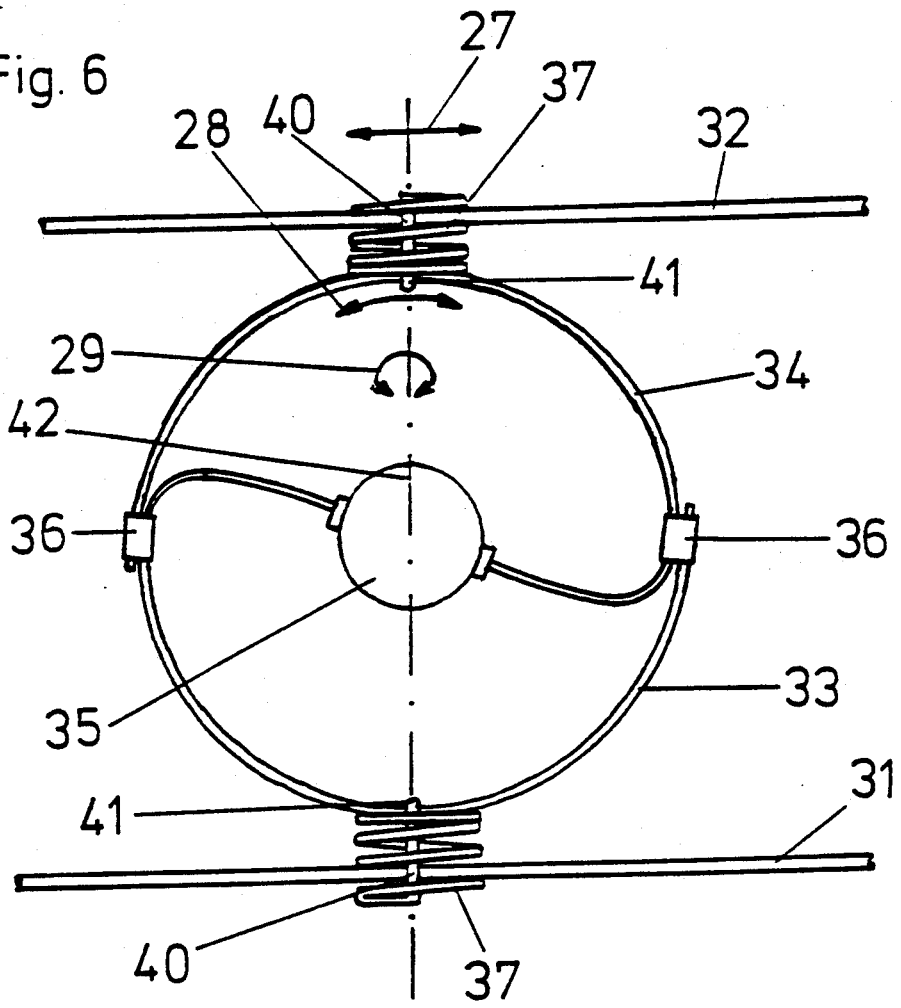
Figure 7:
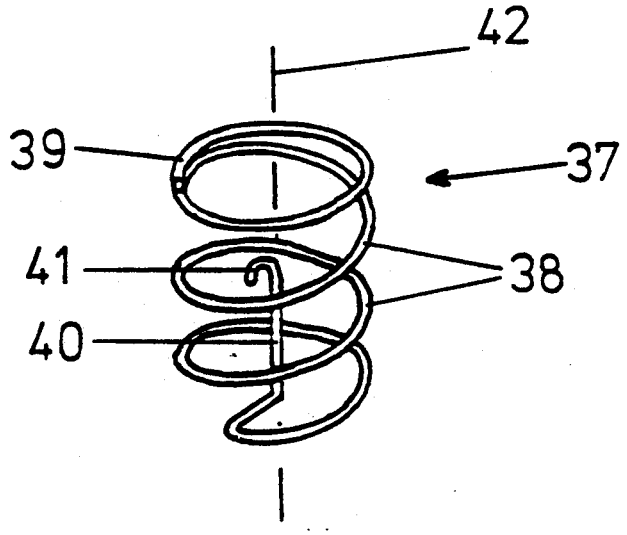

FIGS. 1 to 5 show axial sections through lamp holders according to the invention; FIG. 6 shows a plan view of a lamp holder clamped to two line wires; and FIG. 7 shows an oblique view of a clamping element according to FIG. 6.

Figure 2:
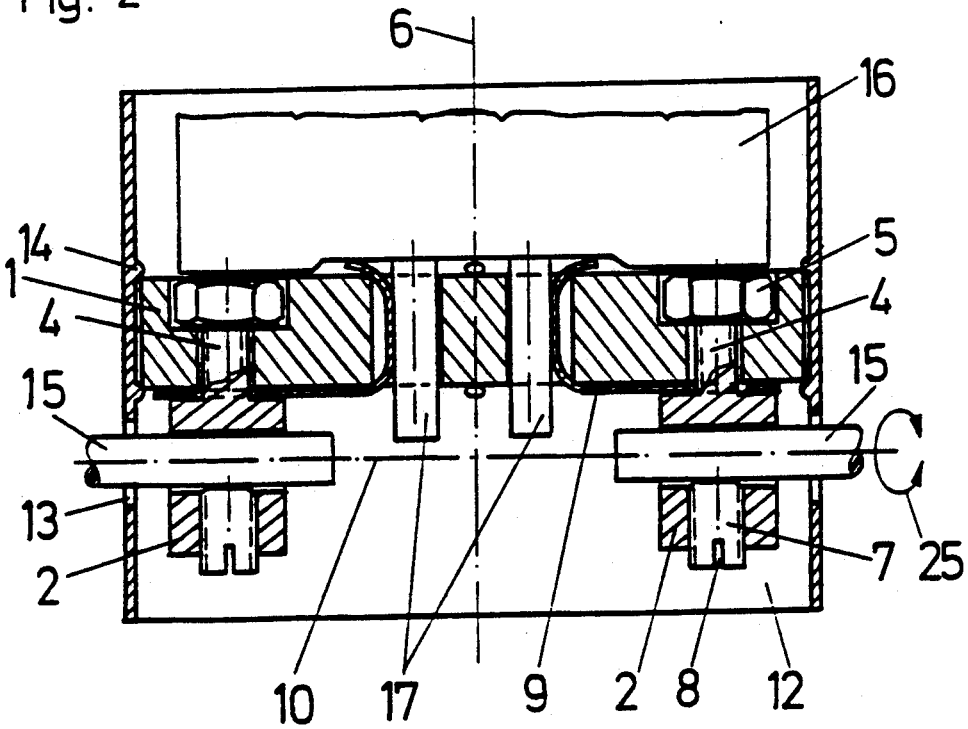

A lamp holder 35 has a cap 1 formed by a cylindrical disc of insulating material, to which an external shell 12 is latched by means of lugs 14 reaching behind the cap edge. The cap 1 is mounted on two connection terminals 2, which each have a conductor receiving bore 3 for clamping flexurally stiff conductor ends 15 (FIG. 2). The two conductor receiving bores 3 are aligned with one another, the result being an axis of rotation 10, which extends perpendicular to the axis 6 of the cap 1. The lamp holder is thereby rotatable about the conductor ends 15, which may be inserted from outside, and penetrate an opening 13 in the shell 12. Moreover, the cap 1 is provided with plug-in openings 11 for the contact pins 17 of a lamp 16, the diameter of the plug-in openings 11 being enlarged. A curved contact piece of a flat contact spring 9 projects through the plug-in opening 11, and establishes the mechanical and electrical connection with the contact pins 17, a good fit and a secure grip being achieved for the lamp 16.

In the embodiments shown in FIGS. 1 to 4, the correction terminals 2 are formed as screw terminals. Each connection terminal 2 consists of a parallelepipedshaped base having the conductor receiving bore 3, which base on one side carries radially to the conductor receiving bore 3 a threaded pin 4, and on the opposite side has a threaded bore, into which a further threaded pin 7 with an actuating opening 8 at the end is inserted. In this regard, the basic pin 7 forms the clamping screw for clamping the conductor end 15 and for fixing the desired position of the lamp holder. The threaded pin 7 can also, in this regard, come to a point on the conductor side, which point presses into the conductor end 15, which could, by the way, also be provided with a circumferential groove, when the threaded pin 7 is tightened. Naturally, the threaded pin 7 can also be formed by a conventional head screw.

The threaded pin 4 projecting from the connection terminal 2 penetrates a bore of the cap 1, and is provided at the back with a nut 5, which is inserted, especially in a form-fit fashion, into a recess of the cap 1. Clamped between the connection terminal 2 and the cap 1 is the flat contact spring 9, which is penetrated by the threaded pin 4 and whose free, bent end forms the already mentioned contact piece, which passes through the plug-in opening 11 to provide contact with the contact pin 17 of the plugged-in lamp 16. Instead of the threaded pin 4 provided with a nut 5, it would also be possible for a head screw to be inserted in a second threaded bore of the base of the connection terminal 2. As may be seen from FIG. 2, the lamp holder can be twisted (arrow 25) about the conductor ends 15 defining the axis of rotation 10, the base of the two connection terminals 2 forming two bearing bushes, and be fixed in any desired position by the threaded pins 7.

Figure 3:
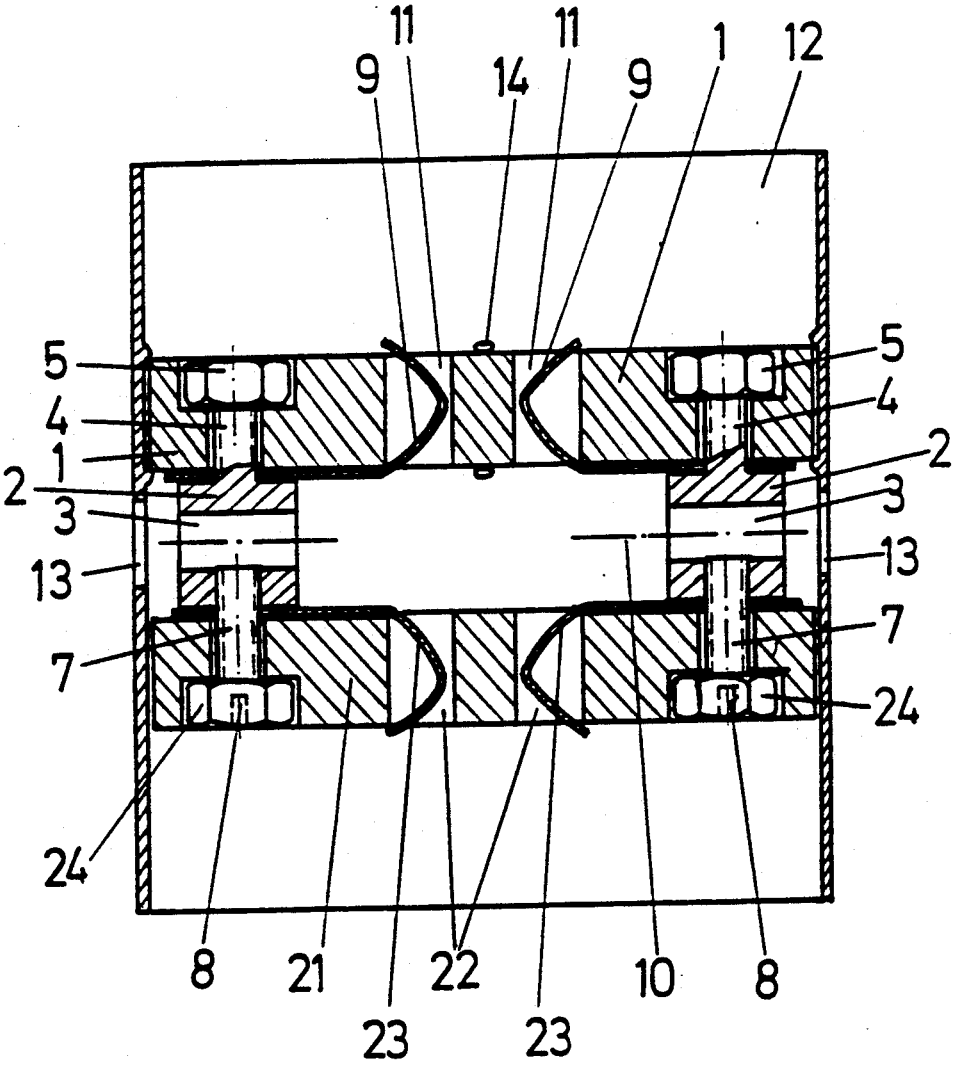

Shown in FIG. 3 is a second embodiment in which a second cap 21 of identical formation is mounted on the bases of the connection terminals 2, forming a mirror image of the cap 1 with respect to the axis of rotation 10. The two threaded pins 7, which are somewhat longer in this embodiment, each penetrate a further contact spring 23 and the second cap 21, on the outside of which nuts 24 are arranged in recesses. In this regard, the threaded pins 7 form, in their turn, the clamping screws for the conductor ends 15 and for the further contact springs 23. With their bent ends, which form contact studs, the latter pass through plug-in openings 22 for the contact pins 17 of a second lamp 16. The remainder of the design of the lamp holder shown in FIG. 3 corresponds to that described with reference to FIGS. 1 and 2.

Figure 4:
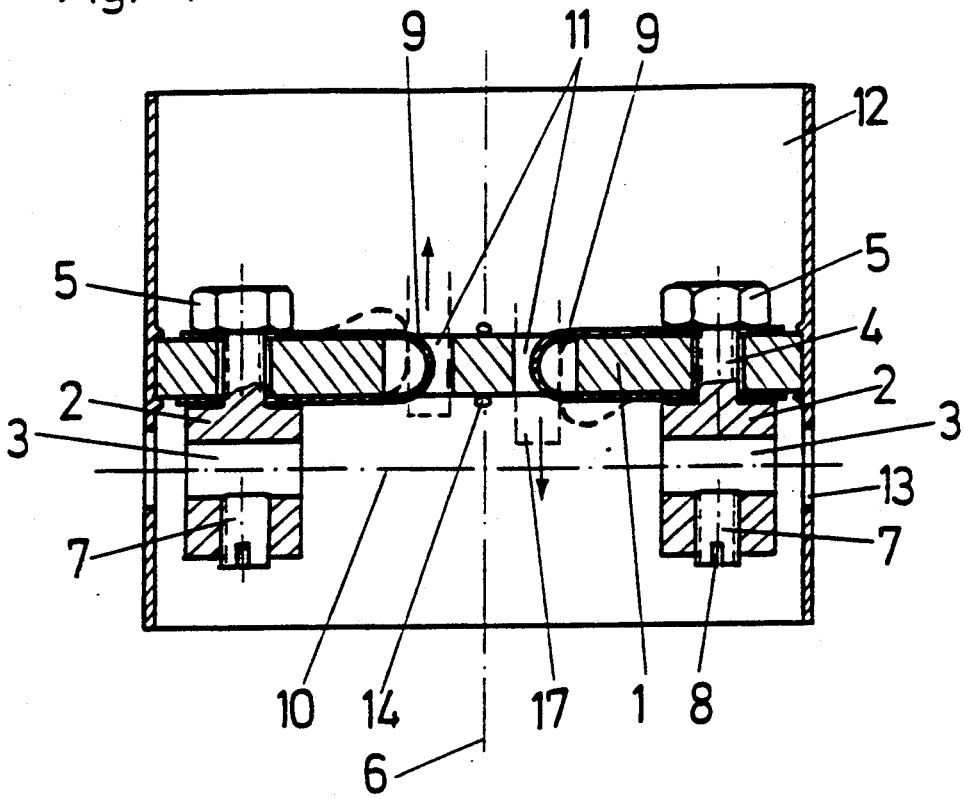

A further embodiment of a single holder, which can also be doubled up, is shown in FIG. 4. The essential difference by comparison with the first embodiment according to FIGS. 1 and 2 resides in the arrangement of the contact spring 9, which is bent from a flat component into a U-shape, and is penetrated at both ends by the threaded pin 4. Upon the insertion of a contact pin 17 in the plug-in direction, the curved contact piece of the contact spring 9, which piece projects through the plug-in opening 11, is deformed, by virtue of being clamped at the end, in approximately the asymmetric fashion represented on the right by dashes in FIG. 4. This leads, on the one hand, to a higher contact pressure at the inserted contact pin 17, and on the other hand to an increased initial resistance against the extraction of the contact pin 17, since the contact piece must first be converted into the form asymmetric in a mirror fashion with respect to the extraction direction (FIG. 4, left), while being subjected to a stronger compression. The remaining design of the lamp holder likewise corresponds to that already described for FIG. 1.

Figure 5:
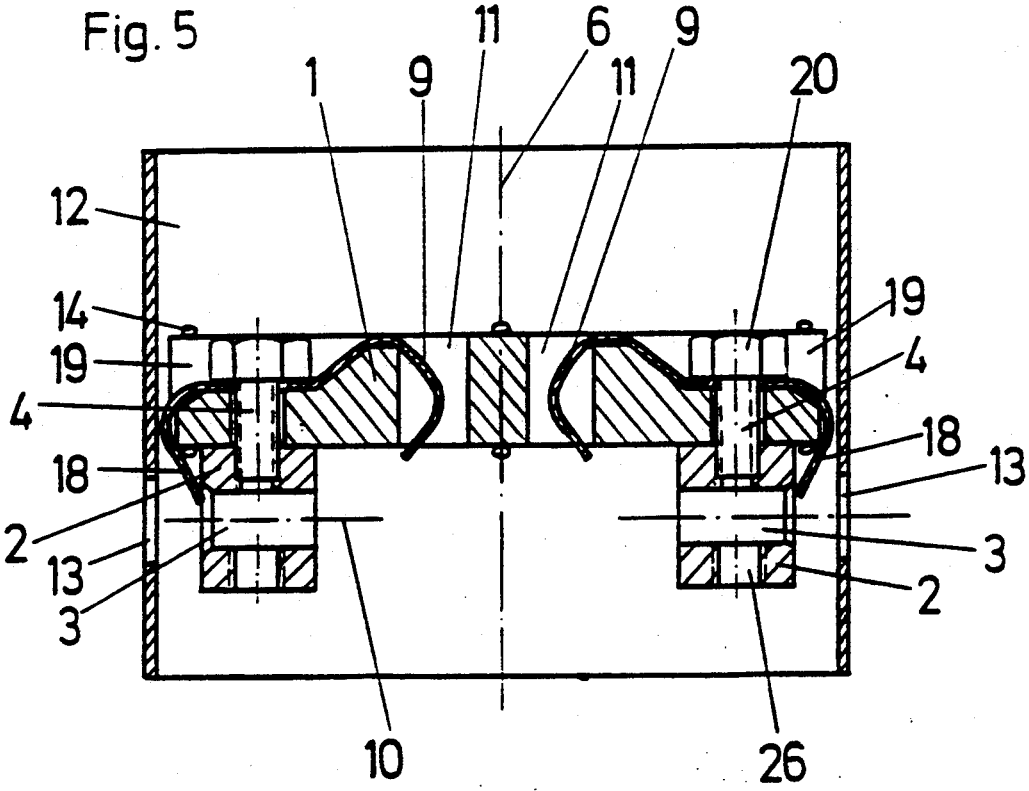

FIG. 5 shows a somewhat modified embodiment of a single holder, which can equally be supplemented by a second cap to form a twin holder. The base of the connection terminals 2 once again has a parallelepiped form, and possesses on both sides a threaded bore 26 perpendicular to the conductor receiving bore. The cap 1 and a possible second cap 21), are provided at the outside with a fairly large cut out 19, into which the contact spring 9 is inserted. The threaded pin 4 is formed by the head screw represented, the head 20 of which is counterbored in the cut out 19. The head screw penetrates the contact spring 9 and the cap 1, and is screwed into the base of the connection terminal 2, although not serving to fix the conductor ends 15. In this embodiment, then, each connection terminal 2 represents a screwless terminal, in which the fixing of the conductor end 15 takes place with a terminal stud 18, which is arranged to extend obliquely to the entry opening of the conductor receiving bore 3, and forms the second final section of the contact spring 9, of which the first end section, in its turn, forms the contact stud projecting through the plug-in opening 11 of the cap 1. The terminal stud 18 ends in the usual way in a knife edge, which is pressed into the plugged-in conductor end or into a circumferential groove formed there. Consequently, the terminal stud 18, which bends outwards upon insertion, clamps the conductor end 15 in place, and ensures the electrical contact. For the purpose of torsionless fixing, it is possible, in the embodiment shown as a single holder, for a clamping screw to be additionally screwed into the free threaded bore 26, if required. In an embodiment as twin holder corresponding to FIG. 3, the additional safeguard against twisting is not required, since due to the symmetric design a neutral equilibrium is provided in each position, and the clamping effect on the conductor end 15, which is doubled by the second contact spring 9, is intensified, in any case.

Moreover, it would be possible, if required, also by an appropriate curvature of the clamping spring 9 in the bearing area of the head 20 or by a snap ring or another spring element, for the threaded pin 4 also to be used on the conductor end 15 as a supplementary clamping screw for safeguarding against twisting.

FIG. 6 shows an example of the assembly of a lamp holder 35 according to FIGS. 1 to 5 with the aid of the clamping element represented in FIG. 7.

Supply wires 31 and 32 are arranged at a distance from one another in the conventional way, which is not further explained, for example horizontally braced. The connecting wires 33, 34, the ends 15 of which are fixed in the connection terminals 2, are led approximately radially outwards from the lamp holder 35 which is to be installed, and subsequently extend in a semicircle. The free ends are held at another conductor, in each case, by means of insulating connecting elements 36, so that the two connecting wires 33 or 34 supplement one another to form an approximately semicircular, closed arrangement.

The connection of the two connecting wires 33, 34 to the supply wires 31, 32 takes place by means of clamping elements in the form of helical springs 37. These comprise several coils 38, which merge into a first final section 40, which extends on the axis 42 of the helical spring 37 into the interior thereof, and on the end of which a hook 41 is formed. The second end 39 of the helical spring 37 ends in the normal way approximately in a plane.

When not loaded (FIG. 7), the hook 41 lies approximately in the center of the helical spring 37, and upon compression emerges at the second end 39, so that it car be hooked on the connecting wire 33, 34 (FIG. 6). The compression of the helical spring 37 presses the connecting wire 33, 34 against the last coil 38 at the second end 39, and is thus caught in the hook 41. In this process, the connecting wire 33, 34 can be displaced in the hook 41 in the direction of the double arrow 28, as a result of which a rotation of the lamp holder 35 about its axis is achieved. The coils 38 of the helical spring 37 thus preloaded are therefore spaced so close to one another that a supply wire 31, 32 can be clamped at any position between two coils 38, and comes to bear at the final section 40 and penetrates the helical spring 37 essentially diametrically. In this regard, each helical spring 37 can be displaced along the supply wire 31, 32 in the sense of the double arrow 27. Moreover, the helical spring 37 can be swivelled in the sense of the double arrow 29 about the axis 42, the final section 40 rolling on the supply wire 31, 32 clamped between the coils 38. Consequently, the lamp holder 35 can be orientated in any arbitrary position in space.

What is claimed:

1. Lamp holder for low-voltage lamp rotatable about an axis, having an insulating cap which has two connection terminals connected conductively to lamp contacts and each terminal having a receiving bore for a flexurally stiff conductor, characterized in that the two connection terminals of the cap have conductor receiving bores aligned with one another which lie on the axis of rotation so that the receiving bores form bearing bushes for the lamp holder.

2. Lamp holder according to claim 1, characterized in that there is provided at the two connection terminals a second cap which is arranged opposite to the first cap with respect to the axis of rotation.

3. Lamp holder according to claim 2 characterized in that each cap is formed by a cylindrical disc having mounting bores diametrical to an axis of the disc, and in that there are provided at each connection terminal perpendicular to the conductor receiving bore threaded pins which in each case project through said mounting bore of said cap.

4. Lamp holder according to claim 1 characterized in that said cap is formed by a cylindrical disc having mounting bores diametrical to an axis of the disc, and in that there are provided at each connection terminal perpendicular to the conductor receiving bore threaded pins which in each case project through said mounting bore of said cap.

5. Lamp holder according to claim 4, in which there are provided in the cap plug-in contacts for contact pins of the lamp, characterized in that each threaded pin penetrates a flat contact spring having a curved contact stud projecting into a plug-in opening of the contact pins.

6. Lamp holder according to claim 4 screw terminals being provided as connection terminals, characterized in that at least one of the threaded pins forms a clamping screw of the screw terminal.

7. Lamp holder according to claim 1 characterized in that the connection terminals form screwless terminals, with a contact spring having a terminal stud inclined in the plug-in direction and associated with the conductor receiving bore.

* * * * *